US006783461B2

(12) United States Patent
Frazier et al.

(10) Patent No.: US 6,783,461 B2
(45) Date of Patent: Aug. 31, 2004

(54) FLEXIBLE TRACK FOR DASHER BOARD SYSTEM

(75) Inventors: Nick Frazier, Denver, CO (US); Gene Marquez, Denver, CO (US)

(73) Assignee: Pepsi Center, Inc., Denver, CO (US)

( * ) Notice: Subject to any disclaimer, the term of this patent is extended or adjusted under 35 U.S.C. 154(b) by 0 days.

(21) Appl. No.: 10/308,127

(22) Filed: Dec. 3, 2002

(65) Prior Publication Data

US 2003/0119591 A1 Jun. 26, 2003

Related U.S. Application Data

(60) Provisional application No. 60/339,820, filed on Dec. 17, 2001, now abandoned.

(51) Int. Cl.[7] ..... A63C 19/10
(52) U.S. Cl. ..... 472/92; 256/24
(58) Field of Search ..... 472/88, 89, 90, 472/92, 94; 256/24, 25, 26

(56) References Cited

U.S. PATENT DOCUMENTS 3,844,539 A * 10/1974 Abbott ..... 256/24
3,986,342 A * 10/1976 MacCracken ..... 62/66
4,927,134 A * 5/1990 Burley ..... 472/90
5,706,625 A * 1/1998 Vallance et al. ..... 52/766
5,709,099 A * 1/1998 Blades et al. ..... 62/235
6,004,217 A 12/1999 Johnston et al.
6,095,503 A * 8/2000 Burley et al. ..... 256/24

* cited by examiner

*Primary Examiner*—Kien Nguyen
(74) *Attorney, Agent, or Firm*—Sughrue Mion, PLLC

(57) ABSTRACT

Apparatuses and methods for providing a track that is operative to hold a shielding panel. A front support and a rear support are positioned on respective sides of the track. A pivot member is disposed beneath the front support and the rear support. The pivot member includes a portion that extends upwardly, between respective sides of the front support and rear support, so as to be secured to the track. An elastic member is positioned between the track and the rear support. The elastic member is operative to bias the track and the shielding panel in an upright position. The elastic member is also compressible by the track when the shielding panel is subjected to a lateral force.

31 Claims, 14 Drawing Sheets

FLEXIBLE TRACK FOR DASHER BOARD SYSTEM

The present application is based on Provisional Application No. 60/339,820, which was filed on Dec. 17, 2001 now abandoned, and which is incorporated herein by reference for all purposes.

BACKGROUND OF INVENTION

1. Field of Invention

Apparatuses and methods consistent with the present invention relate to a dasher board system. Illustrative embodiments of the invention relate to a method and apparatus for providing a dasher board system having a flexible track.

2. Description of the Related Art

The need for a more flexible glass system has been known for some time in the National Hockey League (NHL). During an average season, there are numerous injuries caused when hockey players contact the dasher boards that surround an ice rink. Many of these injuries are shoulder related and are primarily caused by impacting a glass portion of the dasher board assembly.

The dasher boards, which are used to form the boundary around the rinks, are designed to be secure and stable in order to withstand an impact by the players skating or being pushed into the boards during the course of a game. Concerns have been raised, however, about the potentially harmful effects of the stiffness or lack of flexibility of the boards. That is, when a player hits the boards, there exists a potential for injury. If the boards are very stiff, the risk of injury increases. Due to the high speeds obtained by hockey players and their aggressive playing style, the stiffness of the dasher board systems is an issue that needs to be addressed.

There are six main components to a typical dasher board system, each of which can affect how stiff the boards feel to the players. These components are the dasher board, the ice retainer, the anchoring system, the connecting system, the shielding, and the shield mounting system.

The shielding is normally made of tempered glass or acrylic. The acrylic is more flexible than the glass and, at half the weight, it moves more easily when hit and is easier to handle when preparing the ice rink. However, acrylic is more apt to be marked and, therefore, becomes harder to see through. The acrylic material also requires firmer securing than glass when mounted or it will bend when hit and be pushed out of its supports.

In new "supportless" or "seamless" (real glass) style board systems, the shields are held in a slot or U-channel in the top of the boards. A hypothetical example of a slotted structure for supporting a shield is shown in FIG. 1, where a shield 18 is provided in a U-channel 16 of a track 14. The track 14 is provided with a weld (w) to connect it with a track support plate 24, and a plurality of track support plates 24 are intermittently positioned along the length to the track 14. The track support plate 24 is also provided with welds (w') to connect it to a front support member 20 and a rear support member 22, to form a rigid track support system 25. The track support system 25 is then vertically supported by a leg (not shown) that extends from a bottom of the track support system 25 to a floor area. The front support member 20 is connected to a main wall portion 12, which faces the ice.

Many arenas have introduced seamless glass systems to reduce a "bad bounce," which is caused when a puck strikes the upright supports used in acrylic systems. The seamless glass also provides for better fan visibility. However, the use of seamless glass increases the risk of injury because the glass is thicker and heavier than acrylic.

Attempts have been made in the past few years to create a seamless system whereby dasher walls move on impact, absorbing some of the shock while maintaining the superior visibility of seamless glass. For example, U.S. Pat. No. 6,004,217 discloses a dasher board assembly that is provided with rotational flexibility such that the entire assembly will pivot about a point above the ice. The '217 patent was invented by Johnston et al., issued on Dec. 21, 1999, and is incorporated herein by reference for all purposes.

However, many prior attempts at making a movable dasher board were unsuccessful because of the way the dasher board walls are often connected to the ice dams beneath them. Loose connections result in walls that do not return to their correct positions after an impact, leading to bad bounces and rinks that do not meet the specifications as set forth by the NHL rules. There is also a risk of injury to the players due to misaligned walls. However, walls that are tightened enough to rigidly retain their positions do not flex at all when struck, and can lead to injuries.

In systems that use the vertical supports, it is also known to mount shields between particular vertical supports that offer some movement to the shielding. The supports themselves may be flexible and designed to move in a mounting hole and support bracket. Also, the shielding may be held in a gasket that offers some movement, so that the shield may move relative to the boards. Further, the '217 patent discloses a shielding panel that is provided with rotational flexibility such that the shielding panel and its support struts, in a supported assembly, will pivot about a point within the dasher board or be pushed substantially parallel with and away from the ice. However, such a system is an integral part of an original dasher board system and is not taught to be used as a secondary modification of a pre-existing dasher board assembly.

SUMMARY OF INVENTION

Illustrative, non-limiting embodiments of the present invention overcome the disadvantages described above and other disadvantages. Also, the present invention is not required to overcome the disadvantages described above and the other disadvantages, and an illustrative, non-limiting embodiment of the present invention may not overcome any of the disadvantages.

An illustrative, non-limiting embodiment of the present invention provides a track having a channel that is operative to hold a shielding panel. A front support and a rear support are provided on respective sides of the track. A pivot member is disposed below the front support and the rear support. The pivot member has portions which occupy respective areas aligned beneath the front support and rear support. The pivot member also has a portion that extends upwardly between respective sides of the front support and rear support and is secured to the track. An elastic member is positioned between the track and the rear support. The elastic member is operative to bias the track and the shielding panel in an upright position. The elastic member is also compressible by the track when the shielding panel is subjected to a lateral force. A spacer is fixed to a bottom portion of the rear support so as to interpose between the rear support member and the pivot member, such that the pivot member is in slidable contact with the spacer upon compression of the elastic member. The spacer may also act to limit lateral movement of the pivot member.

Another illustrative, non-limiting embodiment of the present invention provides a flexible dasher board assembly having a rear support, a track for holding a shielding panel, and pivoting means. The pivoting means is positioned beneath the rear support member and extends outwardly toward the rink such that motion of the pivoting means is limited by a downwardly facing side of the rear support when the shielding member is subjected to a lateral force. A biasing means is positioned between an outer wall of the track and an inner wall of the rear support for biasing the track and the shielding panel in an upright position when the shielding panel is not subjected to the lateral force. The biasing means is also compressible by the track when the shielding panel is subjected to the lateral force.

Another illustrative, non-limiting embodiment of the present invention provides a flexible dasher board assembly having an extension arm which is secured to a track, the extension arm has an end portion that is extended downwardly. A first elastic member is connected to the track and the rear support. A second elastic member is connected to the end portion of the extension arm and a front wall. The first and second elastic members allow for the extension arm to move laterally toward and away from the front wall.

An even further illustrative, non-limiting embodiment of the present invention provides a flexible dasher board assembly having a support plate connecting a front wall and a rear beam. A pivot arm is secured to a track and has an end portion that is extended downwardly. The end portion of the pivot arm is in contact with the support plate such that the support plate provides a pivot point for the pivot arm. Alternately, the support plate may rest on a bracket used to secure the front wall to an ice dam.

Yet another illustrative, non-limiting embodiment of the present invention provides a method of modifying an existing dasher board system to include a movable track for holding a shielding panel, where the movable track is positioned between a front support member and a rear support member. The method includes releasing the track from its initial position by cutting it into segments. A pivot member is attached to a bottom of the track so that the pivot member extends between the front and rear support members and also extends underneath the front and rear support members. A spacer is disposed on an underside of the rear support member such that a portion of the pivot member is in contact with the spacer and another portion of the pivot member is operative to move to a space underneath the front support member, when a force is applied to the shielding panel. Also included in the method is the positioning of elastic members between the track and the rear support member.

BRIEF DESCRIPTION OF THE DRAWINGS

Aspects of illustrative, non-limiting embodiments of the present invention will become more apparent by describing in detail non-limiting embodiments thereof with reference to the attached drawings, in which.

DETAILED DESCRIPTION OF ILLUSTRATIVE, NON-LIMITING EMBODIMENTS

Incorporated herein by reference is Disclosure Document No. 496167, which was filed in the U.S. Patent and Trademark Office on Jun. 29, 2001. Also, a copy of the Disclosure Document is included in the Appendix attached to this application.

The following description of illustrative, non-limiting embodiments of the invention discloses specific configurations, components, processes and operations. However, the embodiments are merely examples of the present invention and, thus, the specific features described below are merely used to more easily describe such embodiments and to provide an overall understanding of the present invention. Accordingly, one skilled in the art will readily recognize that the present invention is not limited to the specific embodiments described below. Furthermore, the descriptions of various configurations, components, processes and operations of the embodiments that are known to one skilled in the art are omitted for the sake of clarity and brevity.

Figure 1:
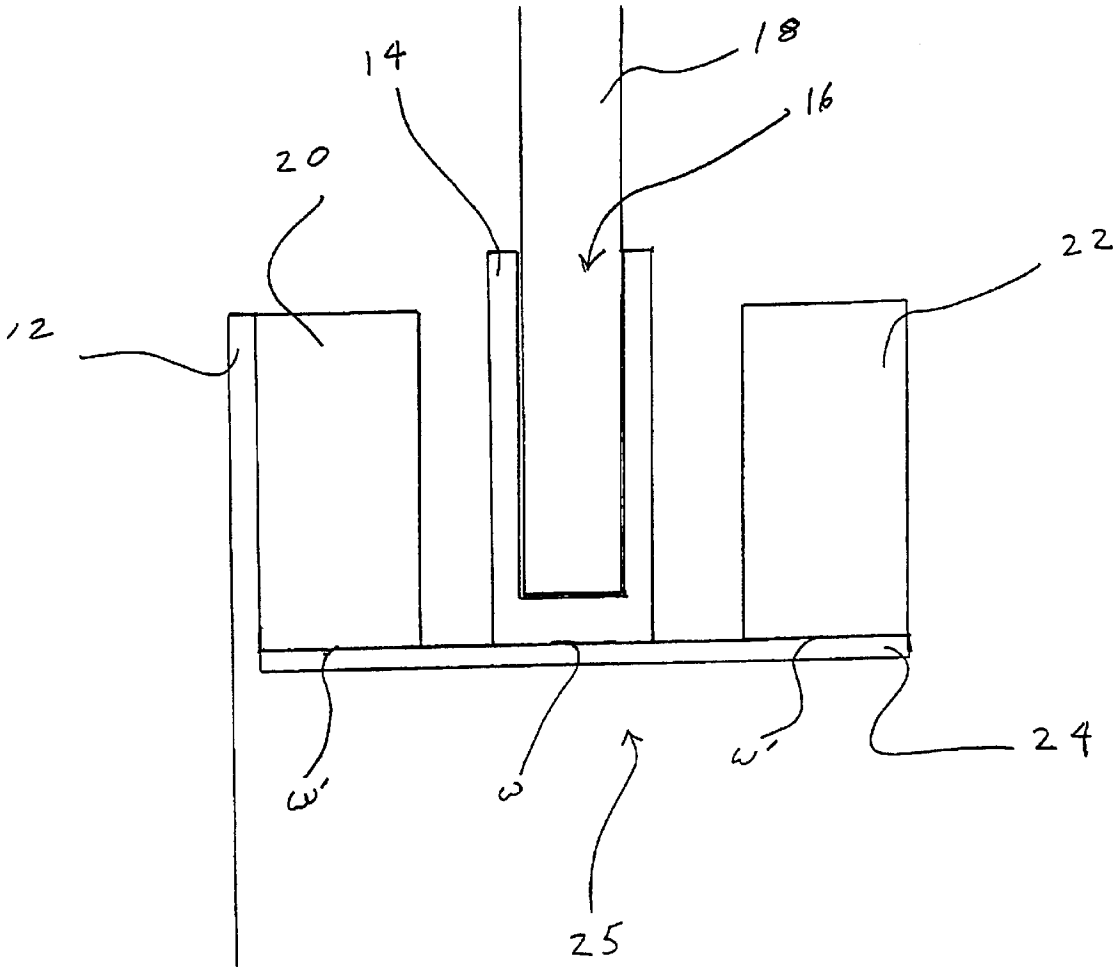
FIG. 1 is a side view showing a hypothetical example of a slotted structure for supporting a shield.
Figure 2:
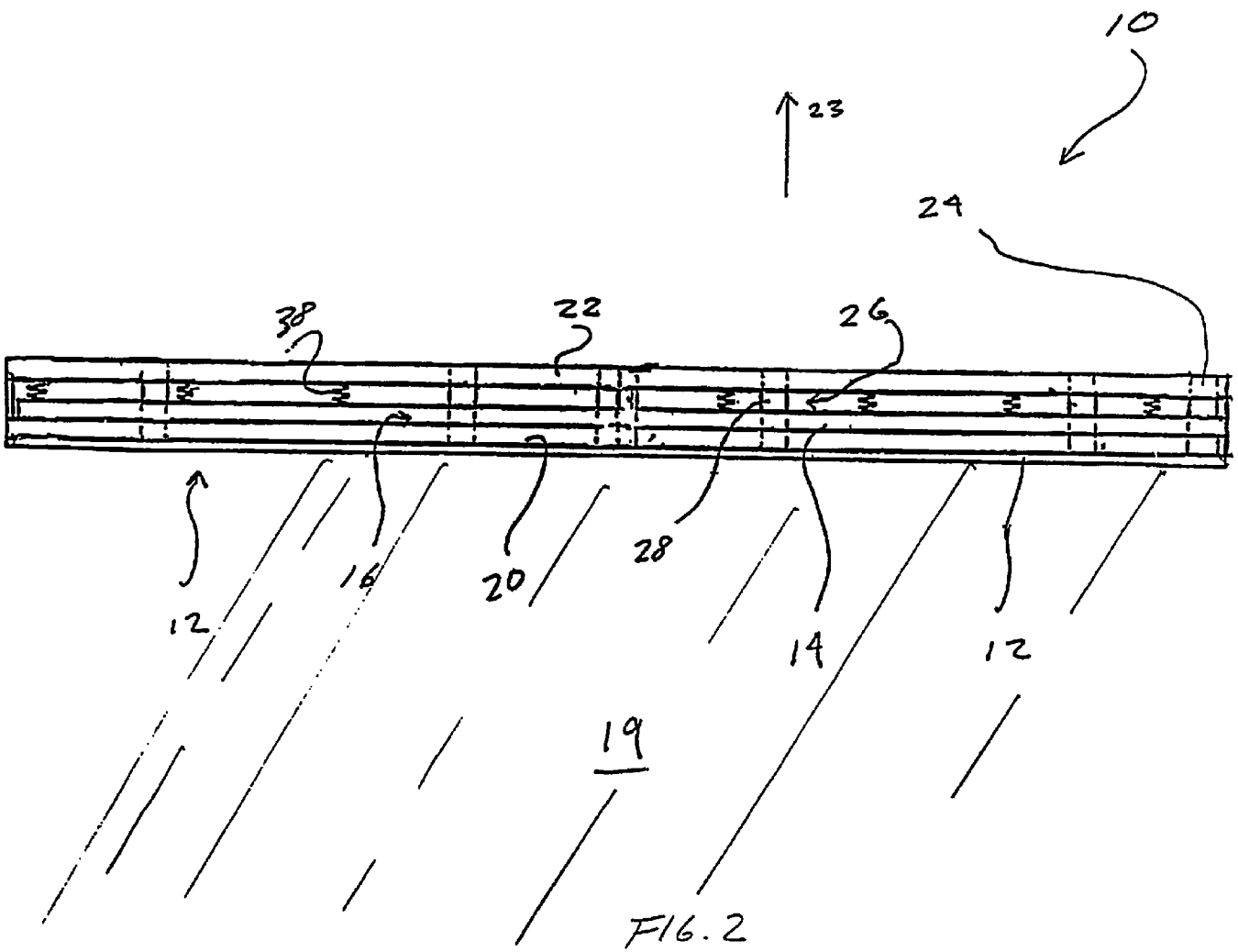
FIG. 2 illustrates a top view of a straight wall portion of a dasher board assembly according to a non-limiting embodiment of the present invention.
Figure 3:
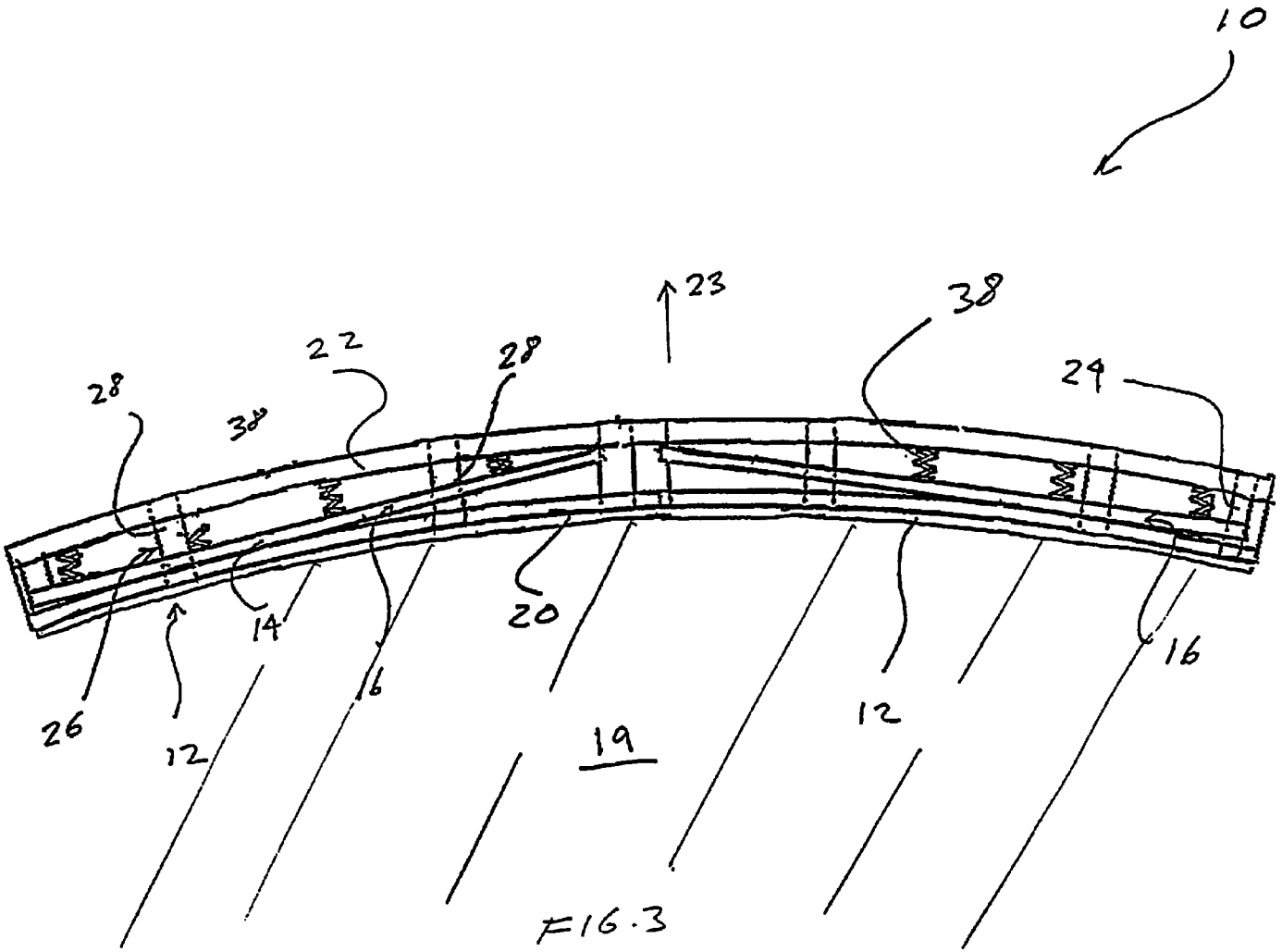
FIG. 3 illustrates a top view of a corner wall portion of a dasher board assembly according to a non-limiting embodiment of the present invention.
Figure 4:
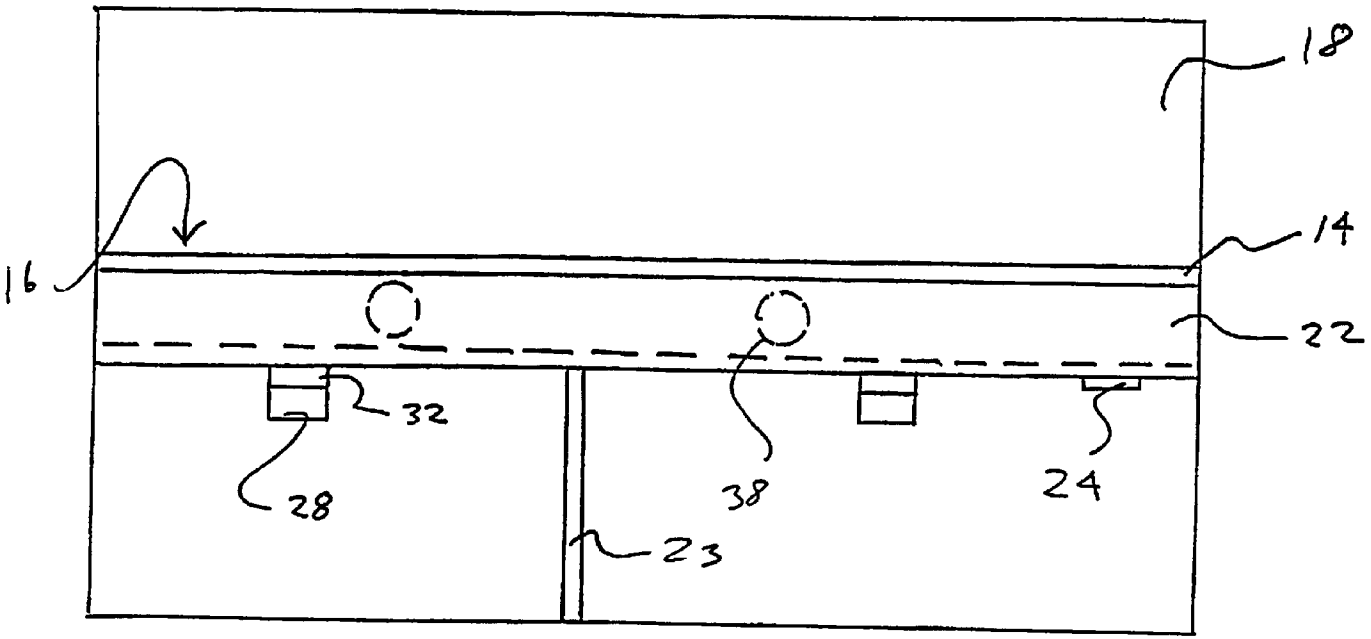
FIG. 4 shows a back side view of a dasher board assembly according to a non-limiting embodiment of the present invention.

Referring to FIGS. 2 and 3, a system according to a non-limiting embodiment of the present invention is shown. FIG. 2 represents the embodiment incorporated into a mid-rink straight portion of an ice rink, while FIG. 3 represents the embodiment incorporated into a corner portion of the ice rink. The system comprises a dasher board assembly 10 which, when used with additional dasher board assemblies, are flexibly connected to each other, in an end-to-end fashion, to form the outside of the rink, such as a hockey rink (not shown). The dasher board assembly 10 comprises a main wall portion 12 that is exposed to the players. With additional reference to FIGS. 4–6, a track 14 is provided having a U-channel 16, into which is inserted an associated piece of glass or shielding member 18. A piece of material may be placed between the glass 18 and the track 14 to further secure or protect the glass 18.

The track 14 is laterally supported, in a direction towards the ice 19, by a front support member 20 and, in a direction away from the ice 19, by a rear support member 22. The front support member 20 is formed behind an upper part of the main wall portion 12, and acts to limit movement of the track 14 in the direction of the ice 19. The rear support member 22 aids in limiting movement of the track 14 in the direction of the audience, with additional support from an elastic member, as discussed further below. The front and rear support members 20 and 22 are coupled together by track support plates 24 that are fixed to respective bottom portions of the front and rear support members 20 and 22. Beams 23 are attached to the track support plates 24 to provide vertical support. In one non-limiting implementation, the track support plates 24 are made of a metal and are held in place by welding. The track support plates 24 are also used to support the track 14.

In accordance with the embodiment, the glass 18 and the track 14 are provided with mobility with respect to the front and rear support members 20 and 22, such that the track 14 will move inwardly, towards the non-ice direction 23, when a force is applied to the glass 18. The force is caused by a player (not shown) making contact with the glass 18.

Figure 5:
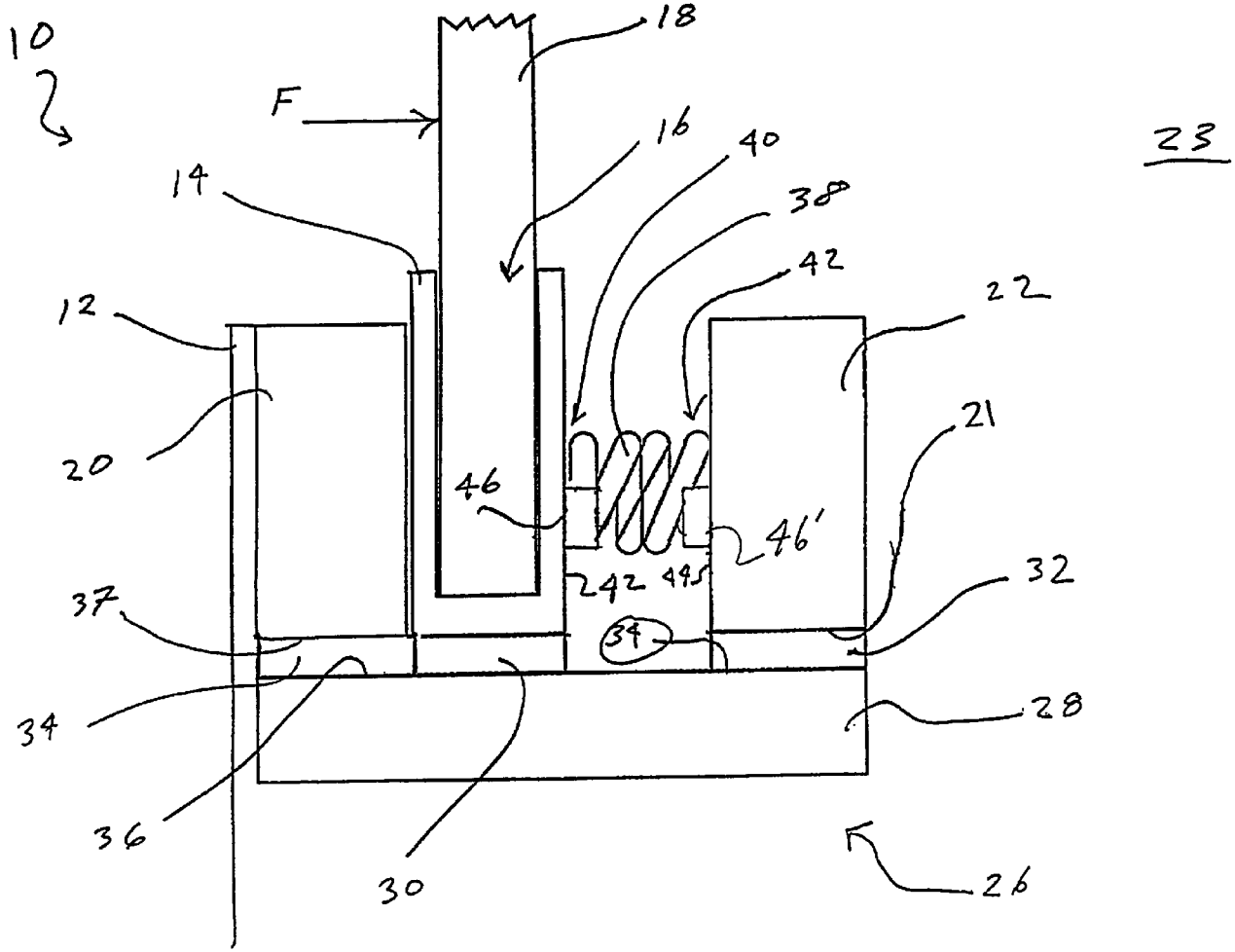
FIG. 5 is a side view showing a system incorporating the movable track of a non-limiting embodiment of the present invention.

With particular reference to FIG. 5, a pivot assembly 26 is illustrated. The pivot assembly 26 includes a pivot member 28, which is slidably positioned so as to extend, in length, from a bottom 37 of the front support member 20 to a bottom 21 of the rear support member 22. The pivot member 28 having portions which occupy respective areas aligned beneath the front support 20 and the rear support 22. The pivot assembly 26 further includes a track spacer 30 provided at a mid-section of the pivot member 28. The track spacer 30 is fixed to the pivot member 28 and to the track 14 so as to act as an interface between the two and allow for forces (F) exerted upon the glass 18 and track 14 to be transferred to the pivot member 28. As will be appreciated, the pivot member 28 and track spacer 30 may be manufactured as one unitary piece, or simply welded together. Also, it may not be necessary to include the track spacer 30, but instead, attach the pivot member 28 directly to the track 14.

The rear support member 22 has a rear support spacer 32 welded to a bottom thereof. The rear support spacer 32 does not move with respect to the support member 22 and acts as an interface between the rear support member 22 and the pivot member 28. An opening or space 34 is provided between an upper front end 36 of the pivot member 28 and the bottom portion 37 of the front support member 20, which is described further below. As will be appreciated by one skilled in the art, the rear support member 22 may be initially manufactured to integrally include the rear support spacer 32 or the pivot member 28 can be designed so as to not need the spacer 32.

In order to provide the track 14 with the ability to be moved in an inward direction, elastic members 38, such as springs, are provided between the track 14 and the rear support member 22. Specifically, the springs 38 respectively have a first end 40 which is positioned on an outer portion 42 of the track 14, and a second end 43 positioned on an inner portion 44 of the rear support member 22. In one embodiment, half circle pieces 46 made of, for example, aluminum are welded to the outer portion 42 of the track 14 for cradling the springs 38, and form spring supporting members. The second ends 43 of the springs 38 may or may not be securely fastened to the rear support member 22, and if they are, half circle pieces 46' may be fastened to the inner portion 44 of the rear support member 22 similar to the half circle pieces 46 on the track. However, if the springs 38 are attached to one of or, both of the track 14 and rear support member 22, it will be appreciated that the springs 38 may be attached by virtually any method known in the art.

Figure 6:
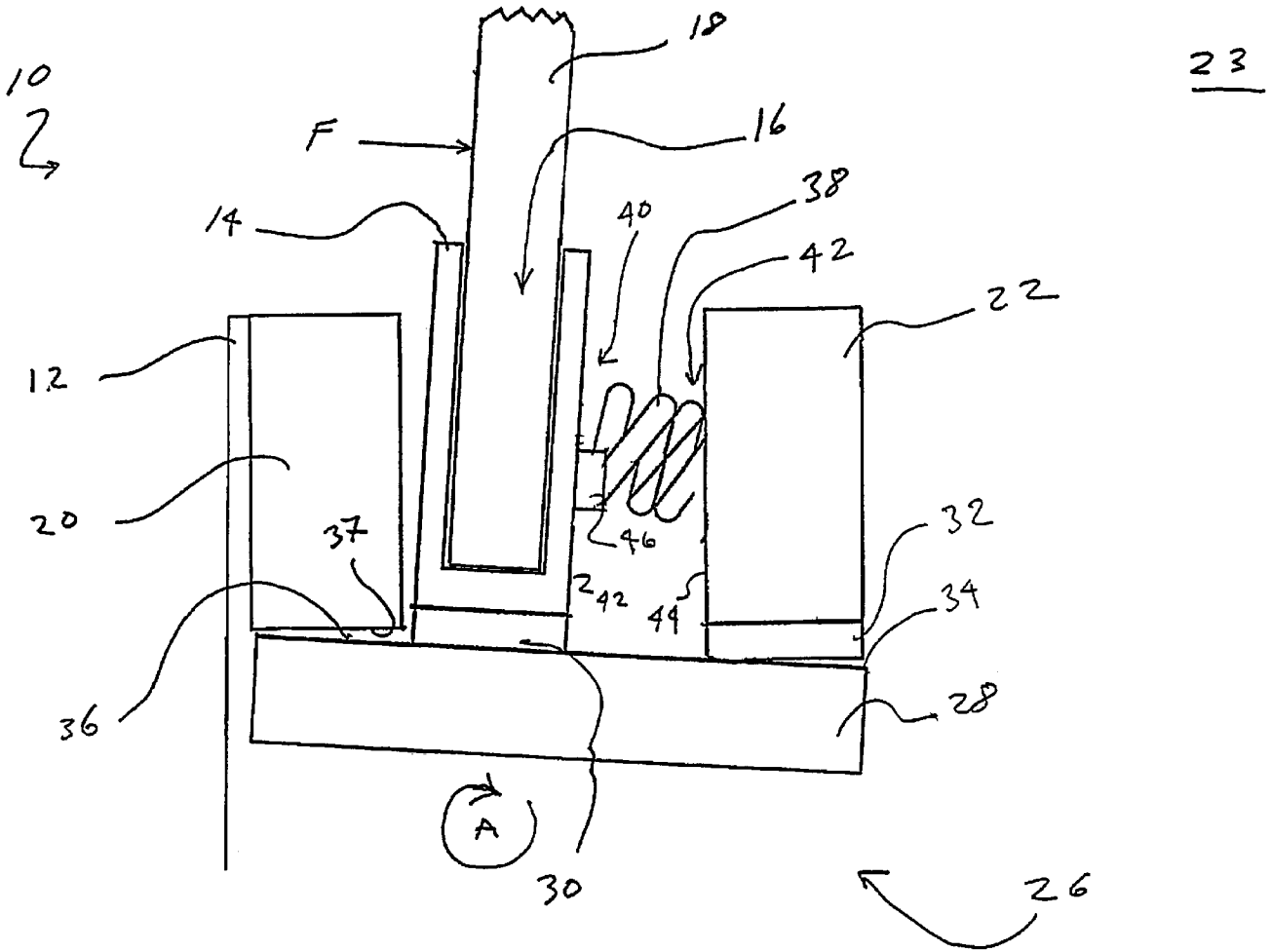
FIG. 6 is a side view showing the movable track of FIG. 5, when subjected to a lateral force.

In operation, with particular reference to FIG. 6, when a player (not shown) makes contact with the glass 18, the force (F) is transferred to the track 14, and the track 14 is forced towards the non-ice side of the dasher board assembly 10. Consequently, the springs 38 are compressed and the glass 18, track 14 and pivot assembly 26 are thrust inwardly, so as to absorb the force. Also, while the pivot assembly 26 is moving, the pivot member 28 is operative to rotate or pivot, in a clockwise (A) direction, which causes the front end 36 of the pivot member 28 to move upwardly, towards the bottom portion 37 of the front support member 20. The motion of the pivot member 28 may be limited by a downwardly facing side of the rear support 22. As the force (F) is removed from the glass 18, the spring 38 decompresses and biases the pivot assembly 26 back towards its normal position.

Figure 7:
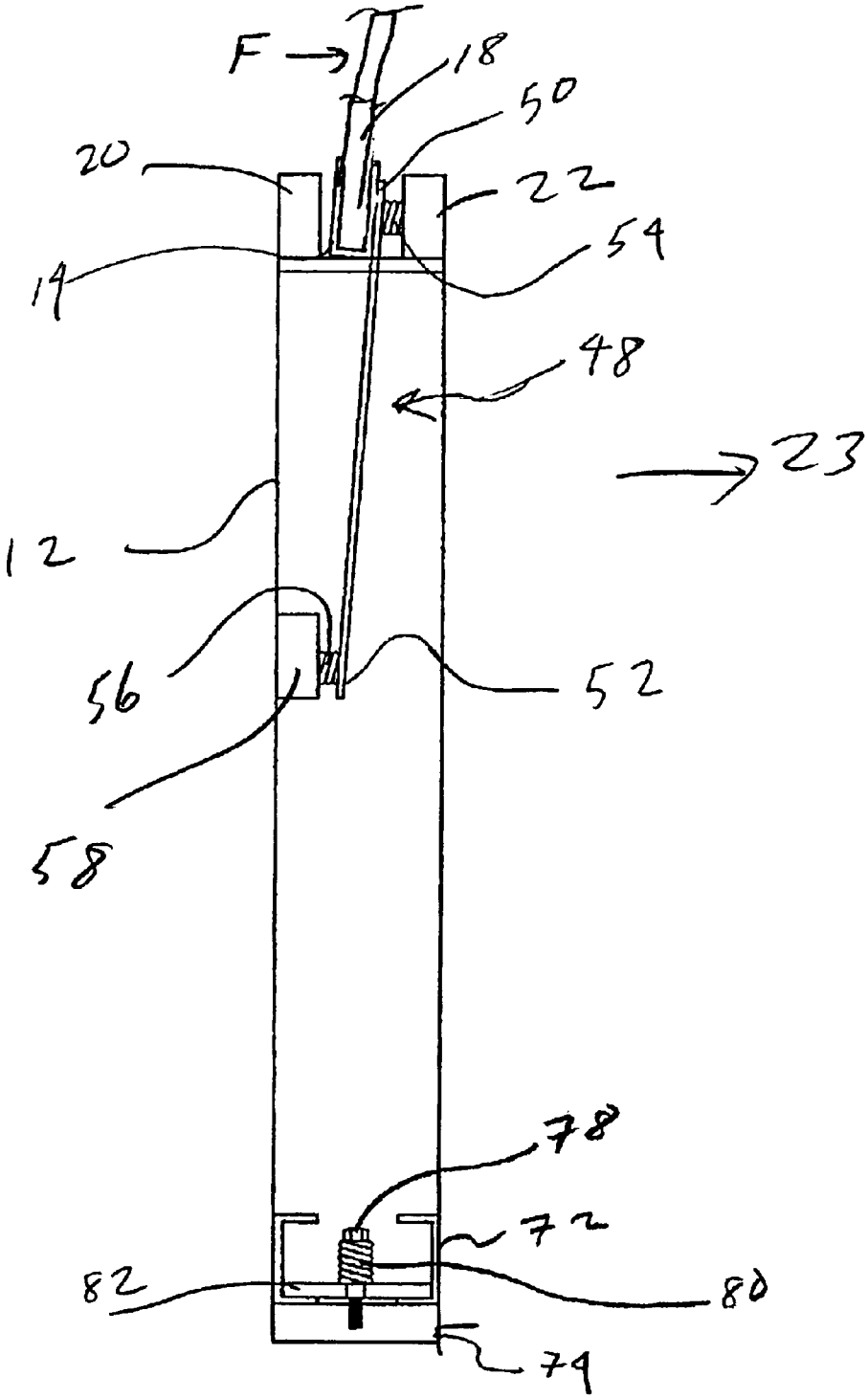
FIG. 7 is a side view showing a system incorporating a movable track of a further non-limiting embodiment of the present invention.

A further non-limiting embodiment is represented in FIG. 7. The glass 18 and the track 14 are provided with mobility with respect to the front and rear support members 20 and 22, such that the track 14 will move inwardly, towards the non-ice direction 23, when a force is applied to the glass 18. The force is caused by a player (not shown) making contact with the glass 18.

An extension member 48 has a first end portion 50 fixed to the track 14 and a second end portion 52 that projects in a downward direction. An elastic member 54 is placed between the track 14 and the rear support 22. The elastic member 54 may be placed at various locations along the track. For example, it may be disposed between two individual extension members along a length of the track or may be connected to the extension member 48. The second end portion 52 is coupled with the main wall 12 by an elastic member 56 that is placed between the second end portion 52 and the main wall 12. In an illustrative embodiment, the elastic member 54 is not vertically aligned with the elastic member 56. Such an arrangement allows for an efficient modification. The elastic members 54 and 56 permit the extension member 48 and track to move in a substantially lateral direction when the glass is subjected to a force (F). If needed, a spacer 58 may be inserted between the elastic member 56 and the wall 12 to provide additional support.

In operation, the track 14 and glass 18 are moved inwardly in a substantially lateral direction when subject to a force (f). The track 14 may be subjected to degree of pivotal motion; however, the two elastic members 54 and 56 are operative to absorb the force exerted by one another so that degree of tilt of the glass 18 is reduced. Such a spring arrangement provides benefits not found in the prior art.

Figure 8:
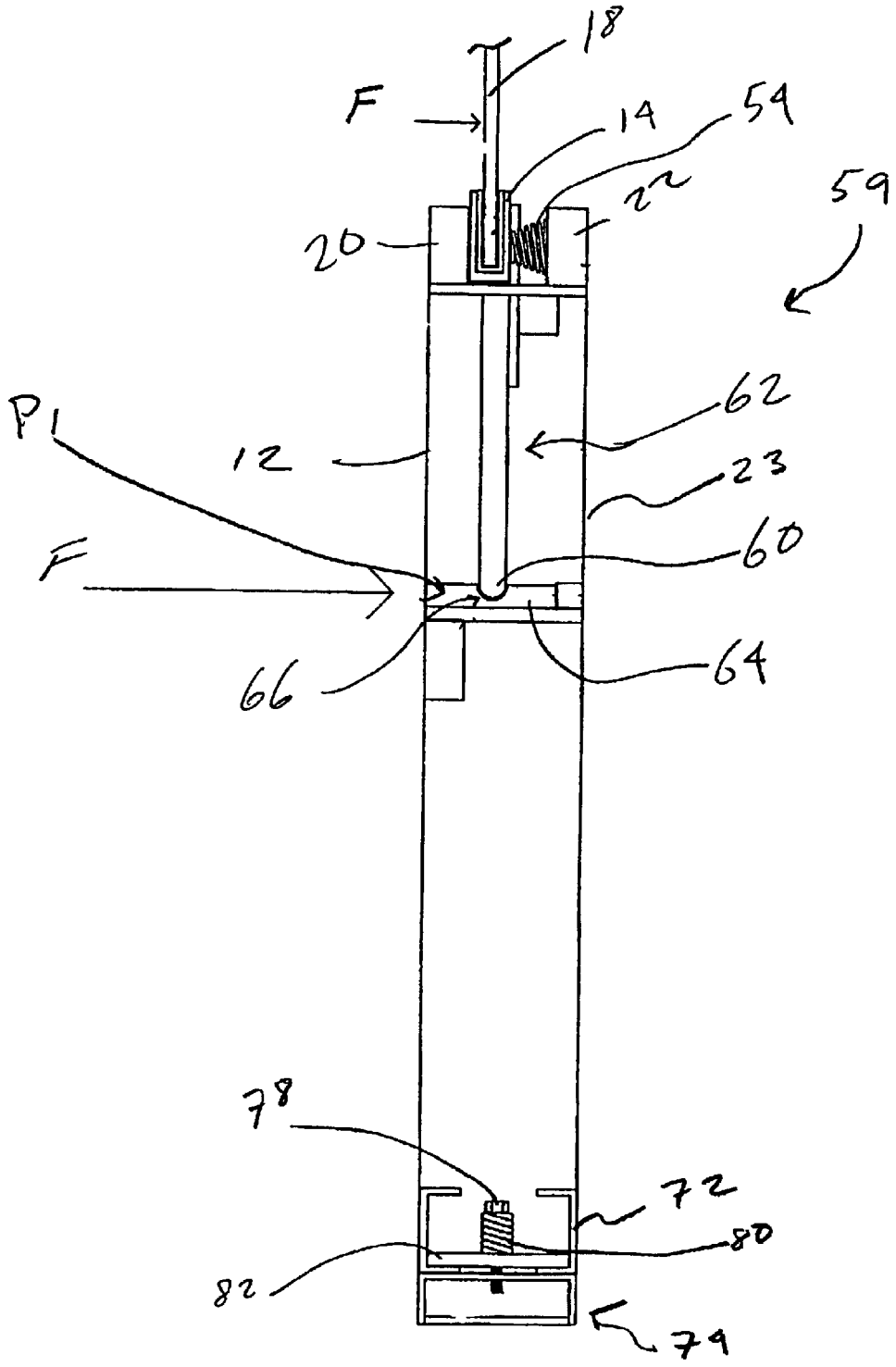
FIG. 8 is a side view showing a system incorporating a movable track of a further non-limiting embodiment of the present invention.

A further dasher board assembly 59 is shown in FIG. 8. In this embodiment, a second end portion 60 of an extension member or pivot arm 62 is positioned on a support 64 positioned beneath the track 14 to form a pivot point p1. In a further modification, the extension member 62 is not vertically aligned with the elastic member 54. The support 64 may be fixed to the wall 12 and the beam 23, or other structural part. The connecting of the support to the existing wall 12 and beam 23 permits an effective modification of an existing system. As one skilled in the art will appreciate, the vertical position of the support 64 from a ground level will change a pivot point of the extension member 62 and can affect how the glass 18 reacts when impacted. The extension member 62 will work as a torque arm upon impact, thus, the force that can potentially be exerted by the players may be taken into consideration when determining the length of the extension member 62 and the position of the pivot point p1.

The second end portion 60 of the extension member 62 maintains its position on the support 64 by being inserted into a cut-out 66 formed in the support 64. The cut-out 66 may be in the form of a notch or other shape that permits the second end portion 60 to pivot on the support 64. The second end portion 60 does not necessarily need to be fixed to the support 64, but can remain in a removable state as long as it maintains its pivotal position during use of the system. This allows for efficient installation and maintenance.

Figure 9:
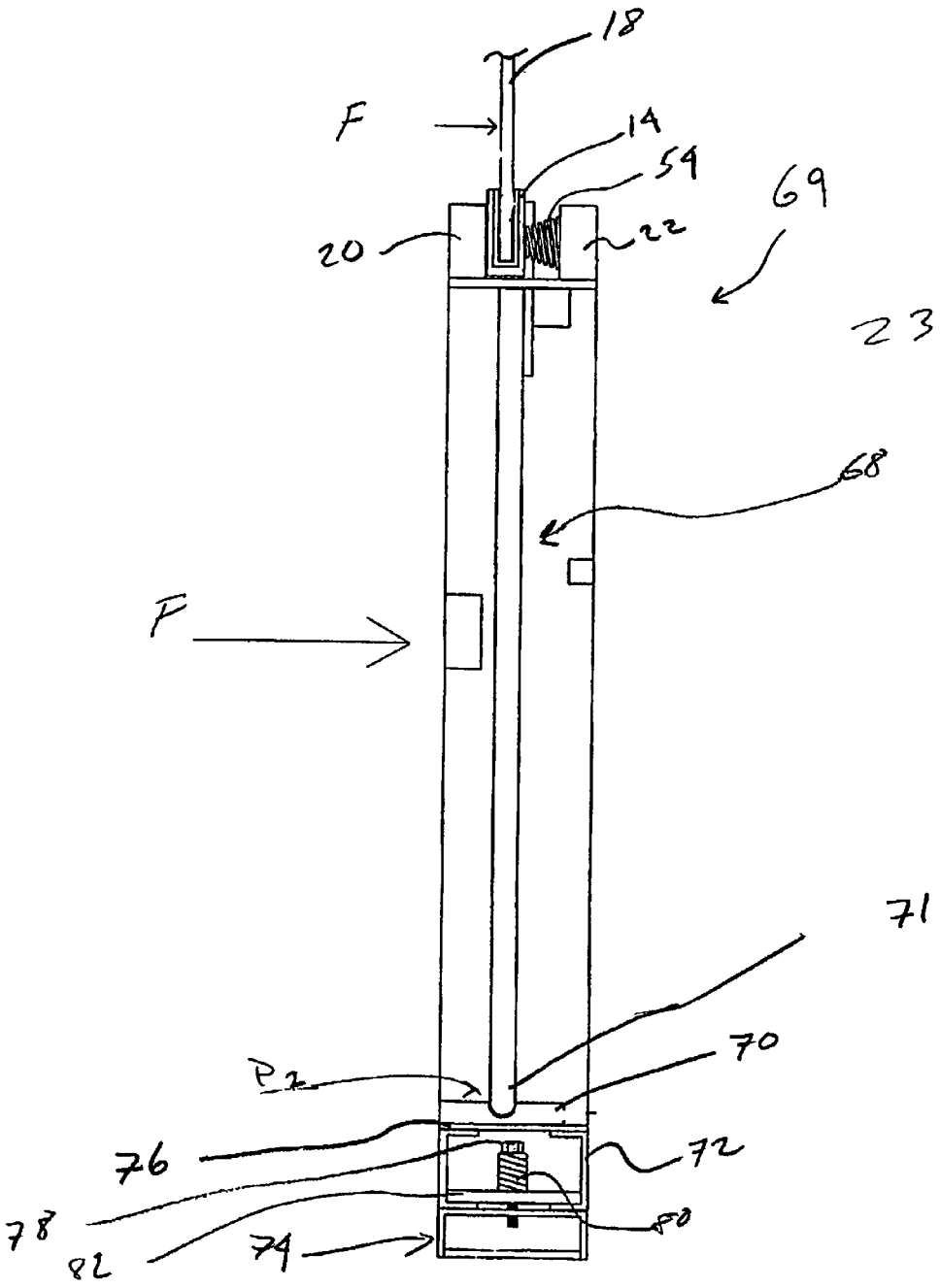
FIG. 9 is a side view showing a system incorporating a movable track of a further non-limiting embodiment of the present invention.

FIG. 9 illustrates a further non-limiting embodiment of a dasher board assembly 69 that is similar to the embodiment of FIG. 8, except that an extension member or pivot arm 68 reaches a bottom area of the dasher board assembly 69 to form a pivot point p2. The extension member 68 of this embodiment is longer than that of the extension member 62 in FIG. 8. A longer extension member is used on end portions of a hockey rink where higher glass is required. The sides of the rink do not require the glass to be as high as the ends and, thus, may utilize configurations with shorter extension members.

With continued attention to FIG. 9, a support 70 is provided to maintain a second end portion 71 of the extension member 68. The support 70 is placed on top of a bracket 72 that is used to secure the dasher board assembly 69 to an ice dam 74. In a further modification, the second end portion 71 is not vertically aligned with the elastic member 54. Such an arrangement may be desirable depending on force distribution and modification requirements. If needed, a spacer 76 may be provided on top of the bracket 72 to serve as a base.

Figure 10:
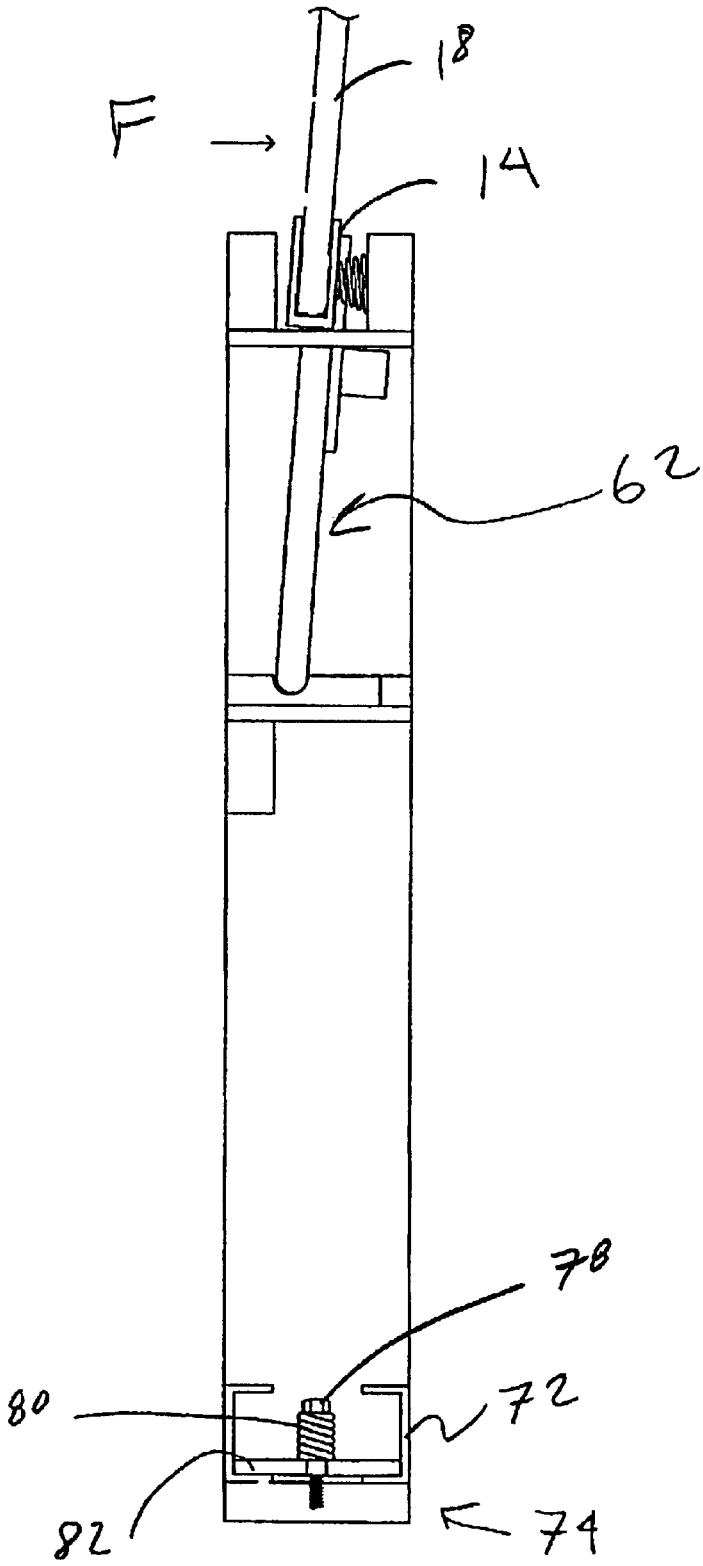
FIG. 10 is a side view of the embodiment of FIG. 8 having a force exerted thereon.

When a player (not shown) makes contact with the glass 18, the force (F) is transferred to the track 14, and the track 14 is forced towards the non-ice side 23 of the dasher board assembly 69. Consequently, the elastic member 54 positioned between the track 14 and the rear support 22 is compressed so that the track 14 and glass 18 are thrust inwardly to absorb a portion of the force (F). Due to the second end portions 60 and 71 respectively having pivot points p1 and p2, the track 14 and associated components can move both horizontally and along an angle of rotation. This causes the glass to move is such a manner that the impact force from the player is efficiently transferred from the glass 18 to the elastic members, along with the elements that are connected thereto. FIG. 10 illustrates an example of how the track 14, glass 18 and extension member 62 may be moved when subjected to a Force (F).

A further feature which may be included with any of the above-described embodiments is shown in FIGS. 7–11. The bracket 72 which attaches the various dasher board assemblies to the ice dam 74 is fastened with a bolt 78, or a similar fastening member. An elastic member 80, is provided between a head of the bolt 78 and a base portion or plate 82, so as to surround the bolt and be held in place by the bolt. The elastic member 80 is operative to be deformed so as to imparted motion to the wall 12 and, thus, the rest of the dasher board assembly, when a force is exerted or transferred to the glass 18 or wall 12.

Figure 11:
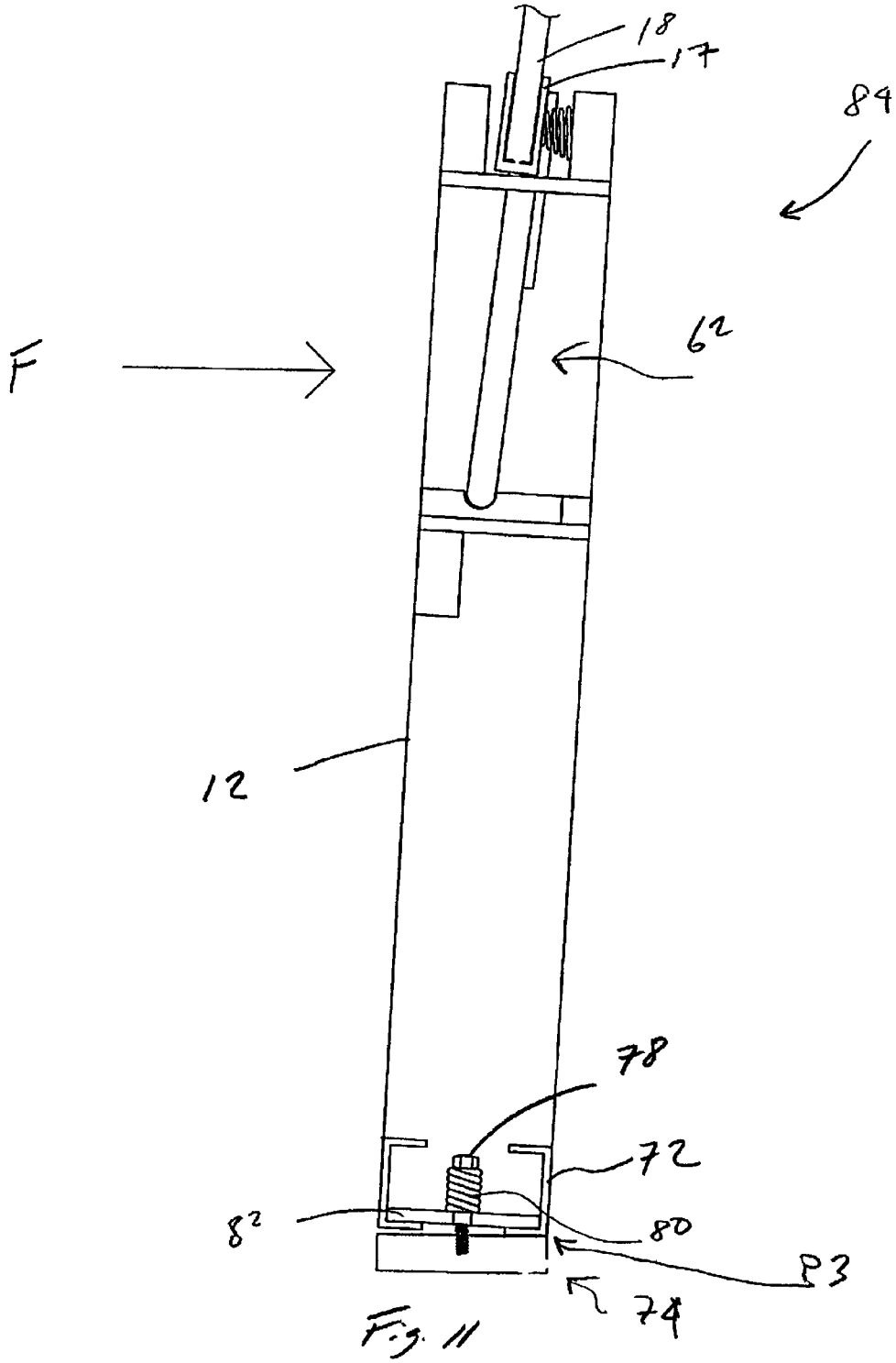
FIG. 11 is a side view showing a system incorporating a movable track of a further non-limiting embodiment of the present invention.

With particular reference to FIG. 11, the bracket 72 is operative to be rotated away from the ice dam 74, along with the wall 12 and other portions of the shown dasher board assembly 84. In this illustrative embodiment, a pivot point p3 is located between the bracket 72 and the ice dam 74. Because the bracket 72 is directly connected to the ice dam 74 by the bolt, the full assembly 84 is operative to be moved. Once the force (F) is removed, the biasing action of the elastic member 80 returns the board assembly 69 to its normal position. By connecting the bracket 72 directly to the ice dam, an existing system is easily modified.

Figure 12:
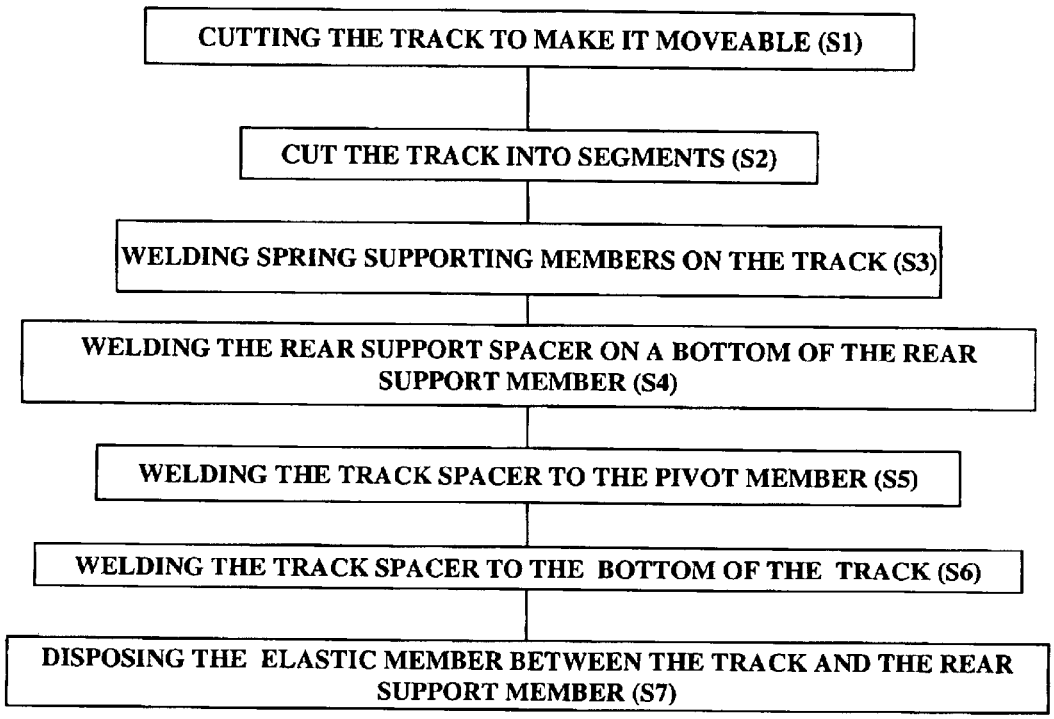
FIG. 12 is a diagram representing a method according to a non-limiting embodiment of the present invention.
Figure 13:
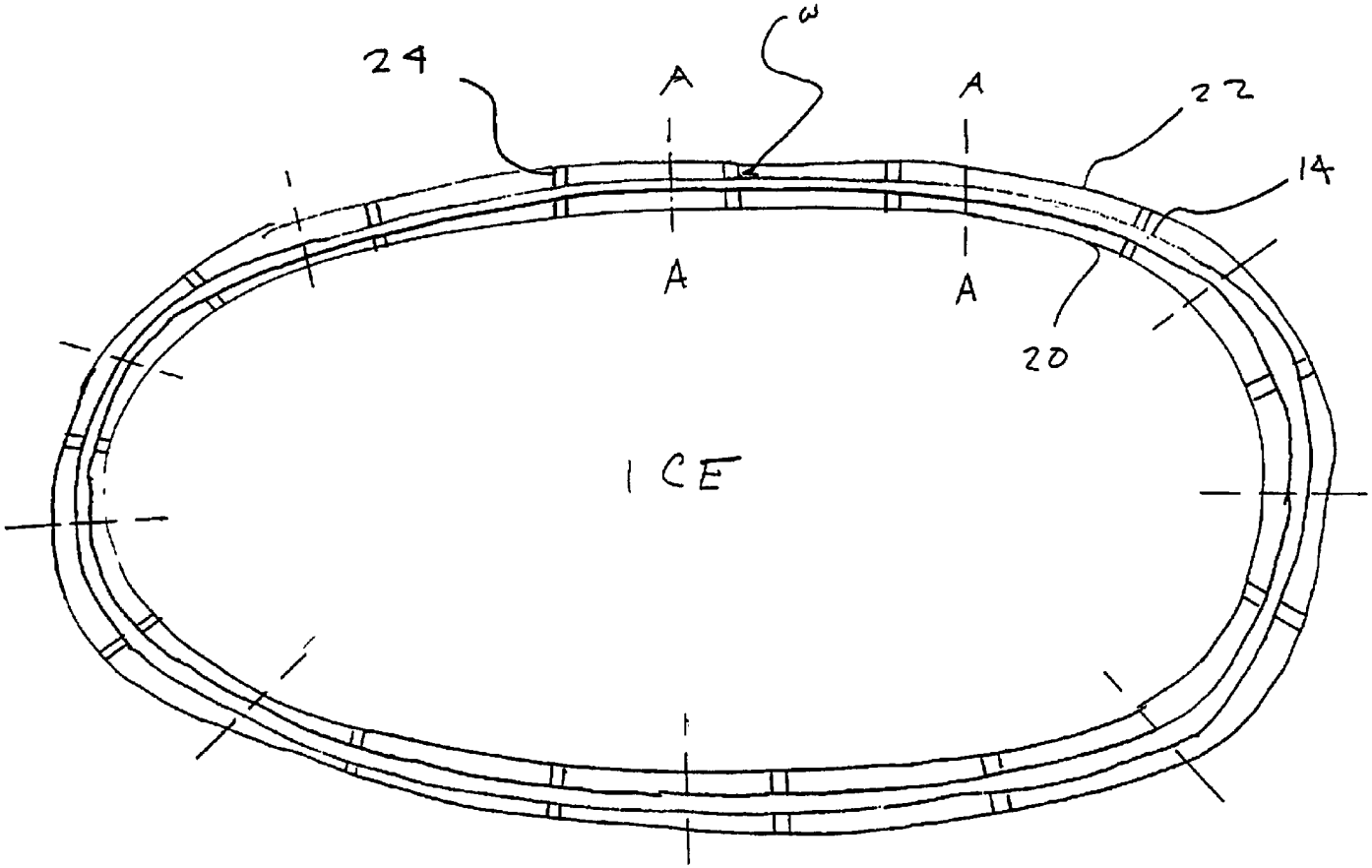
FIG. 13 is a top view of an ice rink that is used to show exemplary cutting locations according to a non-limiting embodiment of a method of the present invention.

Dasher board assemblies of the prior art are integrally designed into and installed with the original dasher boards. However, the present invention provides for a method of modifying an existing dasher board system to incorporate the above described flexible dasher board systems. The method includes, as represented in FIG. 12, cutting the track 14 to make it movable (S1), by cutting the welded portions (w) between the track 14 and the support members 24. With additional reference to FIG. 13, the track 14 is then cut into segments, for example, the track 14 may be cut along the lines A—A (S2). The track 14 may need to be further cut down by, for example, a few inches, so there is no obstruction from sides of adjacent tracks or other parts of the assembly. The half circle pieces or supporting members 46 are spaced and welded to the track 14 to maintain the position of the elastic members 38, which will be installed (S3). As one skilled in the art will appreciate, the distance in which the half circle pieces 46 are separated will affect the force distribution among the springs 38 and the force along the track 14. According to one embodiment of the invention, the springs 38 are placed at equal distances from each other.

With particular reference to the embodiment of FIG. 5, the rear support spacer 32 is formed from a rectangular piece of metal and is welded to the bottom portion 21 of the rear support member 22 (S4). Due to the rear support spacer 32 being welded, it does not move with respect to the support member 22, but instead allows the pivot member 28 to be in sliding contact with a surface of the rear support spacer 32.

A support spacer is not formed on the bottom portion 37 of the front support member 20. Thus, a space 34 is provided between the upper front end 36 of the pivot member 28 and bottom portion 37 of the front support member 20. As described above, this space 34 allows the assembly 26 to pivot and for the track 14 and glass panel 18 to have a greater range of motion when subjected to a force. However, it will be appreciated that if it is desired to strictly constrain the lateral motion of the track 14 to a horizontal movement with no tilt, an additional spacer can be fixed to the bottom 37 of the front support member 20, so as to substantially eliminate the space 34.

In general, the track support plates 24 are typically present before the modification, and are left in place. To prevent the track 14 from being separated from the rest of the dasher board assembly 10, the track spacer 30 is welded to the pivot member 28 (S5), and the track spacer 30 is also welded to the bottom of the track 14 (S6). The elastic members or springs 38 are disposed between the track 14 and the rear support member 22 (S7) so as to bias the track 14 and glass panel 18 in an upright position, while allowing for these members to flex inwardly and slightly rotate when a force is applied to the glass panel 18. The springs 38 are held in place using the disclosed spring supporting members 46 or other fastening methods known in the art. This results in the track 14, track spacer 30 and the pivot member 28 being movable as one piece with respect to the front and rear support members 20 and 22, while maintaining the integrity of the system.

Figure 14:
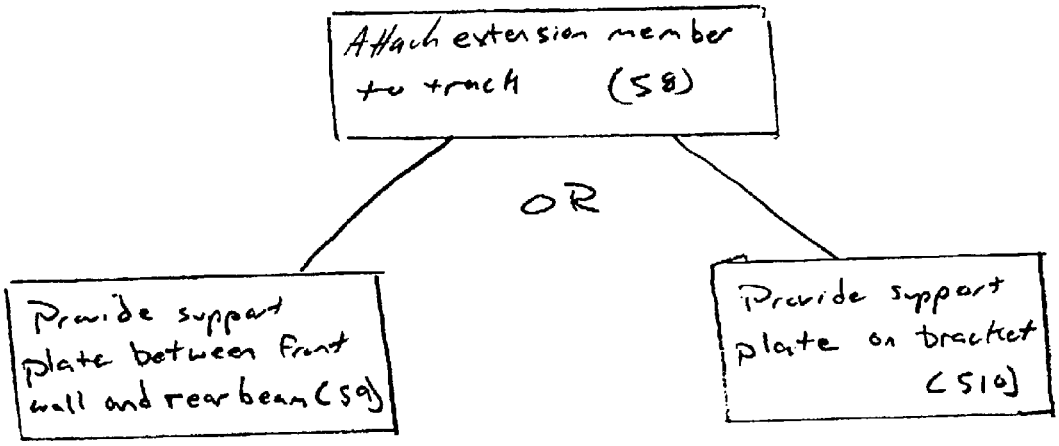
FIG. 14 is a diagram representing a further method according to a non-limiting embodiment of the present invention.

In regard to the embodiment shown in FIGS. 7–11, the above described steps S1–S3, and S7 will be the same. However, steps 4–7 will not apply. Instead additional steps, as shown in FIG. 14 will be required, such as attaching the extension member 48, 62, or 68 to the track (S8). Depending on the embodiment, it will also be necessary to provide the support plate 60 or 70 which respectively support the second end portions 60 and 71 of the extension members (S9). The support plate 64 may be welded to the front wall 12 and rear beam 23. Alternatively, the support plate 70 may be provided on top of the bracket 72 (S10).

It may also be desirable to provide retaining clips (not shown) made of polycarbonate, for example, on top portions of the glass shields 18 to retain adjacent glass shields 18 in close relation to each other. Thus, even in the absence of vertical support members for supporting the glass 18, the use of the clips aids in keeping the adjacent glass panels 18 aligned with each other. The clips are designed to provide a desired degree of resilience and flexibility, such that the top portions of the glass panels 18 are able to move in relation to each other and return to their proper position.

Although the previous embodiments show and describe the elastic member as being a spring, it will be appreciated that virtually any other device known in the art can be used as an elastic member. For example, an elastic member may include, but is not limited to, a spring, cone spring, rubber bumper, air cartridge, foam, a piston-style shock absorber, balloon, or the like.

Although the previous embodiments show and describe element 18 as being glass, it will be appreciated that other forms of transparent material can be used.

Although the track spacer and the rear support spacer are described as being welded in place, it will be appreciated that other fastening methods may be used such as the use of an adhesive or bolting.

Although the method is shown and described in a specific order, it will be appreciated that the steps may be completed in other physically feasible orders. Also, the disclosed apparatuses may be installed in an original dasher board assembly, as well as being retrofitted into an existing system.

The previous description of the preferred embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. Therefore, the present invention is not intended to be limited to the embodiments described herein, but is to be accorded the widest scope as defined by the limitations of the claims and equivalents thereof.

What is claimed is:

1. A flexible dasher board assembly comprising:

a track having a channel, the channel being operative to hold a shielding panel;

a front wall;

a front support positioned adjacent said front wall;

a rear support;

a pivot member coupled to said track, said pivot member having portions which occupy respective areas aligned beneath said front support and said rear support; and an elastic member positioned between said track and said rear support, said elastic member being operative to bias said track and the shielding panel in an upright position, and said elastic member being compressible by said track when the shielding panel is subjected to a lateral force.

2. The flexible dasher board assembly as claimed in claim 1, wherein said elastic member is a spring.

3. The flexible dasher board assembly as claimed in claim 1, wherein said pivot member includes a portion that extends upwardly between respective inner sides of said front support and said rear support so as to be secured to said track.

4. The flexible dasher board assembly as claimed in claim 1, wherein a spacer is fixed to a bottom portion of said rear support so as to interpose between said rear support and said pivot member, said pivot member being in slidable contact with said spacer upon compression of said elastic member.

5. The flexible dasher board assembly as claimed in claim 1, further including a semi-circular piece of metal which extends from said track and holds an end of said elastic member on said track.

6. The flexible dasher board assembly as claimed in claim 1, further including supporting means for holding an end of said elastic member on said track.

7. The flexible dasher board assembly as claimed in claim 1, wherein said shielding panel is glass.

8. The flexible dasher board assembly as claimed in claim 1, further comprising a plurality of shielding panels, each of said shielding panels associated with a flexible dasher board assembly and held in respective tracks.

9. The flexible dasher board assembly as claimed in claim 1, wherein the portion included with said pivot member which extends upwardly is a separately fixed piece.

10. The flexible dasher board assembly as claimed in claim 1, wherein a track support plate is fixed to said front and rear supports so as to hold said track.

11. A flexible dasher board assembly comprising:

a track having a channel for holding a shielding panel;

a rear support;

means for pivoting said track such that motion of the pivoting means is limited by a downwardly facing side of said rear support; and biasing means positioned between an outer wall of said track and an inner wall of said rear support, said biasing means for biasing said track and the shielding panel in an upright position when the shielding panel is not subjected to the lateral force, said biasing means being compressible by said track when the shielding panel is subjected to the lateral force.

12. The flexible dasher board assembly as claimed in claim 11, wherein a bottom portion of said rear support has a spacer positioned thereon.

13. The flexible dasher board assembly as claimed in claim 12, wherein said pivoting means is fixed to said track and is slidably contacted with said spacer.

14. The flexible dasher board assembly as claimed in claim 11, wherein said biasing means comprises a spring.

15. A flexible dasher board assembly comprising:

a track having a channel, the channel being operative to hold a shielding panel;

a front wall which is to face an ice area;

a rear support;

an extension arm which is secured to said track, said extension arm having an end portion that is extended downwardly past said rear support;

a first elastic member connected to said track and said rear support; and a second elastic member connected to said end portion and said front wall, wherein said first and said second elastic members allow for said extension arm to move laterally toward and away from said front wall.

16. The flexible dasher board assembly of claim 15, wherein said first elastic member is not vertically aligned with said second elastic member.

17. A flexible dasher board assembly comprising:

a track having a channel, the channel being operative to hold a shielding panel;

a front wall;

a rear support;

a rear beam that extends substantially parallel to the front wall in a vertical direction;

a support plate connecting said front wall and said rear beam;

a pivot arm which is secured to said track, said pivot arm having an end portion that is extended downwardly past said rear support; and an elastic member connected to said track and said rear support, wherein said end portion of said pivot arm is in contact with said support plate, such that the support plate provides a pivot point for said pivot arm.

18. The flexible dasher board assembly of claim 17, wherein said support plate has a groove in which said end portion is provided.

19. The flexible dasher board assembly of claim 17, wherein said end portion is not vertically aligned with said elastic member.

20. A flexible dasher board assembly comprising:

a track having a channel, the channel being operative to hold a shielding panel;

a front wall;

a rear support;

a bracket for securing said dasher board assembly to an ice dam;

a pivot arm which is secured to said track, said pivot arm having an end portion that is extended downwardly past said rear support; and an elastic member connected to said track and said rear support, wherein said end portion of said pivot arm is positioned on said bracket so as to provide a pivot point for said pivot arm.

21. The flexible dasher board assembly of claim 20, wherein said end portion is not vertically aligned with said elastic member.

22. The flexible dasher board assembly of claim 20, wherein a support plate is provided on said bracket, and said support plate has a groove in which said end portion of said pivot arm is provided.

23. A method of modifying an existing dasher board system to include a movable track for holding a shielding panel, the movable track being positioned between a front support member and a rear support member, said method comprising:

releasing the track from its initial position;

attaching an extension member to the track; and disposing an elastic member in contact with the track so as to bias the track in an upright position and allow the track to move when a force is applied to the shielding panel.

24. The method of modifying a dasher board system of claim 23, wherein said releasing of the track is done by cutting the track into segments.

25. The method of modifying a dasher board system of claim 23, further comprising:

shortening a length of the track.

26. The method of modifying a dasher board system of claim 23, further comprising:

providing a support member for maintaining a position of the elastic member.

27. The method of modifying a dasher board system of claim 23, wherein the extension member acts as a pivot member.

28. The method of modifying a dasher board system of claim 23, further comprising:

coupling a second elastic member with an end of the extension member that is distal from an end attached to the track.

29. The method of modifying a dasher board system of claim 23, further comprising:

positioning the elastic member so as to not be vertically aligned with the extension member.

30. The method of modifying a dasher board system of claim 23, further comprising:

providing a support plate which creates a pivot point for the extension member.

31. The method of modifying a dasher board system of claim 30, further comprising:

connecting said support plate to a front wall and rear beam.

* * * * *